US009732476B2

(12) United States Patent
Favaron

(10) Patent No.: US 9,732,476 B2
(45) Date of Patent: Aug. 15, 2017

(54) TANGENTIAL GRINDING MACHINE FOR RAILWAY PROFILES

(71) Applicant: FAMA S.R.L., Venezia Mestre (IT)

(72) Inventor: Claudio Favaron, Venezia Mestre (IT)

( * ) Notice: Subject to any disclaimer, the term of this patent is extended or adjusted under 35 U.S.C. 154(b) by 0 days.

(21) Appl. No.: 15/311,443

(22) PCT Filed: Jun. 23, 2015

(86) PCT No.: PCT/IB2015/054676

§ 371 (c)(1),
(2) Date: Nov. 15, 2016

(87) PCT Pub. No.: WO2015/198206

PCT Pub. Date: Dec. 30, 2015

(65) Prior Publication Data

US 2017/0096782 A1 Apr. 6, 2017

(30) Foreign Application Priority Data

Jun. 24, 2014 (IT) ..... VE2014A0037

(51) Int. Cl.
*E01B 31/17* (2006.01)

(52) U.S. Cl.
CPC ..... *E01B 31/17* (2013.01)

(58) Field of Classification Search
CPC ..... E01B 31/17
See application file for complete search history.

(56) References Cited

U.S. PATENT DOCUMENTS 4,205,494 A * 6/1980 Rivoire ..... E01B 31/17 451/347
4,583,327 A * 4/1986 Jaeggi ..... E01B 31/17 451/347
4,862,647 A * 9/1989 Vieau ..... E01B 31/17 451/347
4,908,993 A * 3/1990 Buhler ..... E01B 31/17 451/347
5,293,718 A * 3/1994 Favaron ..... E01B 31/17 451/21
5,567,196 A * 10/1996 Theurer ..... E01B 31/175 451/347

(Continued)

FOREIGN PATENT DOCUMENTS

CH EP 0789108 A1 * 8/1997 ..... E01B 31/17
EP 0843043 5/1998

*Primary Examiner* — Zachary Kuhfuss
(74) *Attorney, Agent, or Firm* — Themis Law

(57) ABSTRACT

A tangential grinding machine slidable on rails to be ground includes a base structure mounted on wheels slidable on the rails to be ground; a grinding unit freely slidable along the cross-members of the base structure, the grinding unit having a frame rigidly movable vertically relative to the base structure towards and away from the rail, the frame being rigidly coupled to at least two longitudinally aligned plates supporting a grinding wheel with a rotatable axis transverse to the rail longitudinal axis; and a bar hinged at its ends to the base structure and to the grinding unit respectively, there being connected to the frame supporting the plates a gear motor provided with a vertical axis worm gear, the end of which rests on the grinding unit, a control unit being associated with the gear motor to control frame descent following wear of the grinding wheel.

9 Claims, 5 Drawing Sheets

(56) References Cited

U.S. PATENT DOCUMENTS

Figure 1:
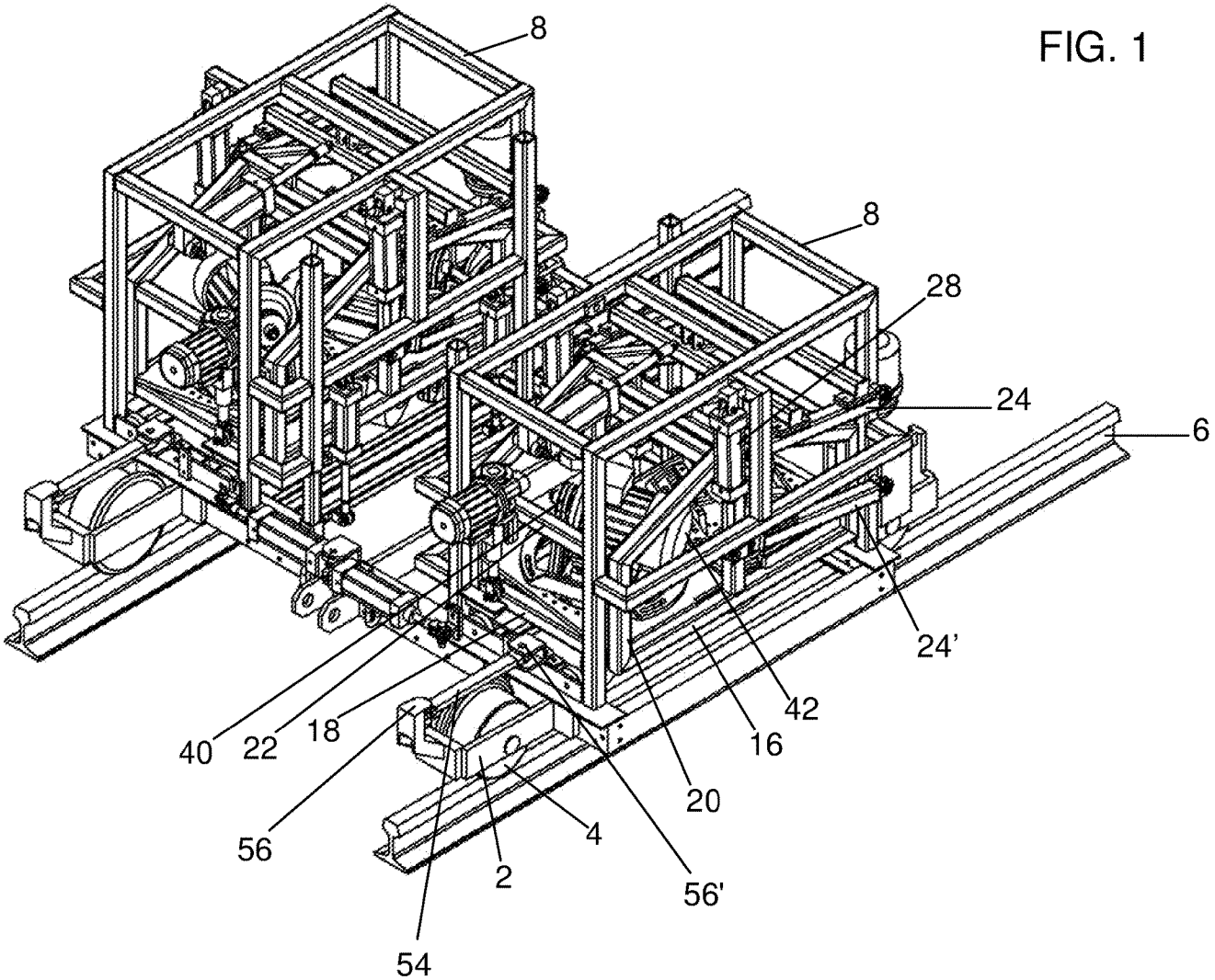

| | | | | |
|---|---|---|---|---|
| 6,921,319 | B2 * | 7/2005 | Knoll | E01B 31/17<br>451/347 |
| 2003/0143928 | A1 * | 7/2003 | Knoll | E01B 31/17<br>451/28 |

* cited by examiner

TANGENTIAL GRINDING MACHINE FOR RAILWAY PROFILES

The present invention relates to a tangential grinding machine used specifically to restore the profile of railway, tramway and/or subway rails, Tangential grinding machines are known comprising a grinding device consisting essentially of a grinding wheel of abrasive material which when rotated removes by abrasion a part of the material with which it comes into contact.

These known machines, i.e. the assembly comprising the grinding device with its abrasive tools, the rotational drive members, its adjustment and replacement systems, and all the other accessory members which ensure their correct operation, currently present a series of limits and drawbacks, in particular in restoring the rail longitudinal profile, which the present invention proposes to eliminate.

One of these drawbacks consists of the fact that each grinding device consists generally of a disc of abrasive material, or grinding wheel, designed to operate with its circumferential band.

As this abrasive disc wears with time, to compensate its working circumference decreases, a pneumatic regulator is used to apply a controlled working pressure via pneumatic cylinders, such as to always ensure mutual contact between the abrasive wheel and the rail.

A drawback of this system consists of the fact that, as the abrasive wheels oscillate, they always follow the rail profile, and consequently also its undulation defects, in particularly those of the longitudinal plane which the present invention is intended to eliminate, noting that the continual increase in train velocities requires rails which are increasingly free of longitudinal defects.

Another drawback of the tangential grinding wheel is the fact that to re-profile a rail an apparatus with a negative contour must be used, such an apparatus being of high cost.

Grinding machines used specifically to restore the profile of railway, tramway and/or subway rails are also known.

A drawback of these machines is that they generally use "cup" grinding wheels, which operate on a narrow longitudinal band of the rails to be ground. This implies the use of several grinding wheels, and as they are mounted on trucks a large number of these must be available to operate on adjacent bands which together cover the entire profile of the rail. An excessive and often unacceptable overall size is involved, together with imperfect execution of the work because of the inevitable faceting. On termination of the work, the rails present a polygonal profile instead of circular, causing a metallurgic shock to the base metal due to successive cusp flattening and intersection between two facets, on the part of railway rails. In addition, those cup wheels which operate on the rail lateral surface are hindered by the presence of natural obstacles such as points, guide and containing blades at the points and, in the particular case of tram-rails, the cement and asphalt plus the actual rail counterblade.

A further drawback is that cup grinding wheels generally have to work on both rails simultaneously for mass balancing reasons. This makes it more difficult to carry out grinding work on a single rail, such as the central earth rail or the outer lateral live rail for subway trains.

EP 0843 043 describes a tangential grinding machine of the type described hereinafter; this machine presents however the drawback that as the two wheels are hinged together, they are unable to grind the rail longitudinal profile, as they oscillate.

The object of the invention is to implement rail grinding in the longitudinal plane.

According to the invention, a grinding machine is provided as described in claim 1.

Figure 2:
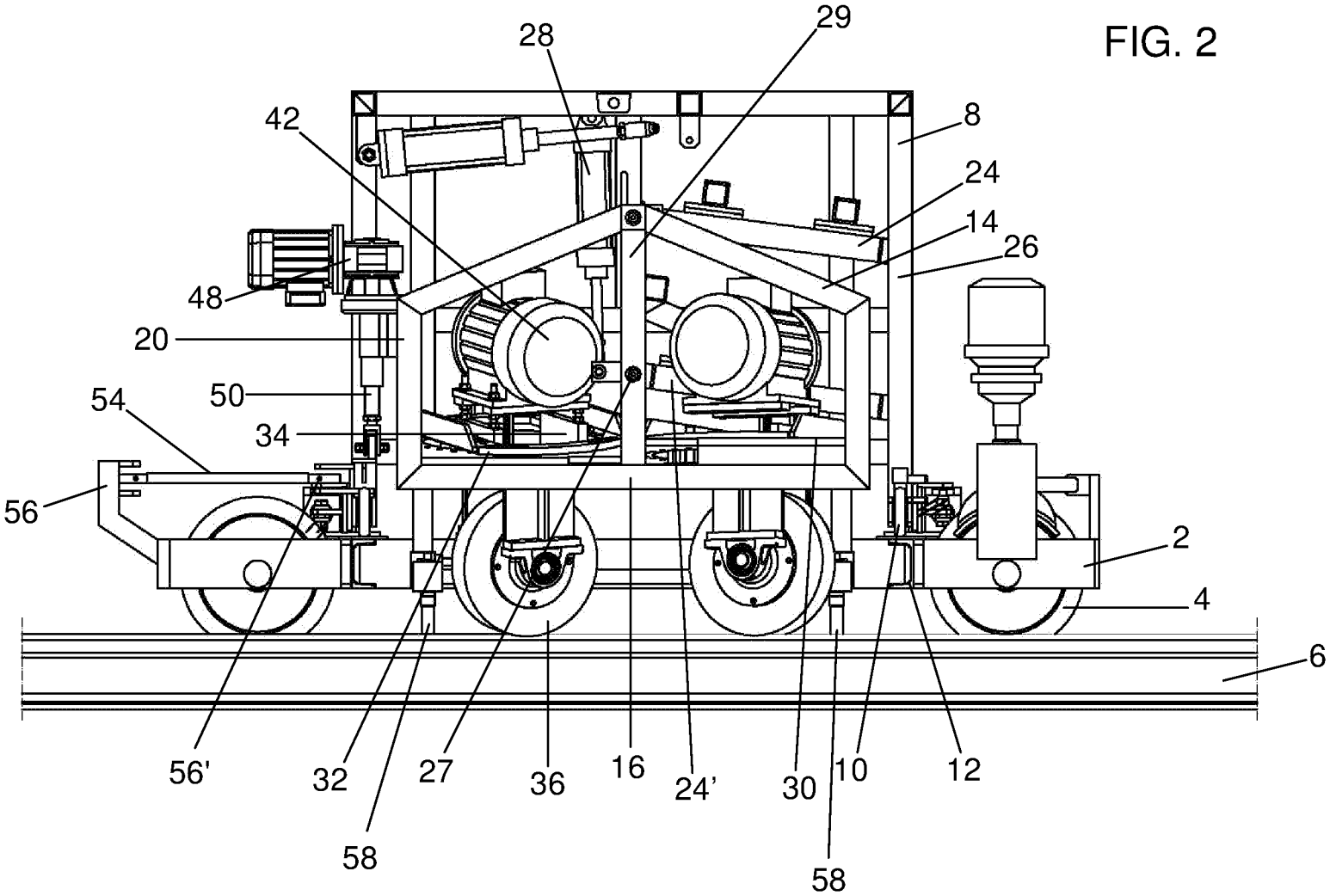
Figure 3:
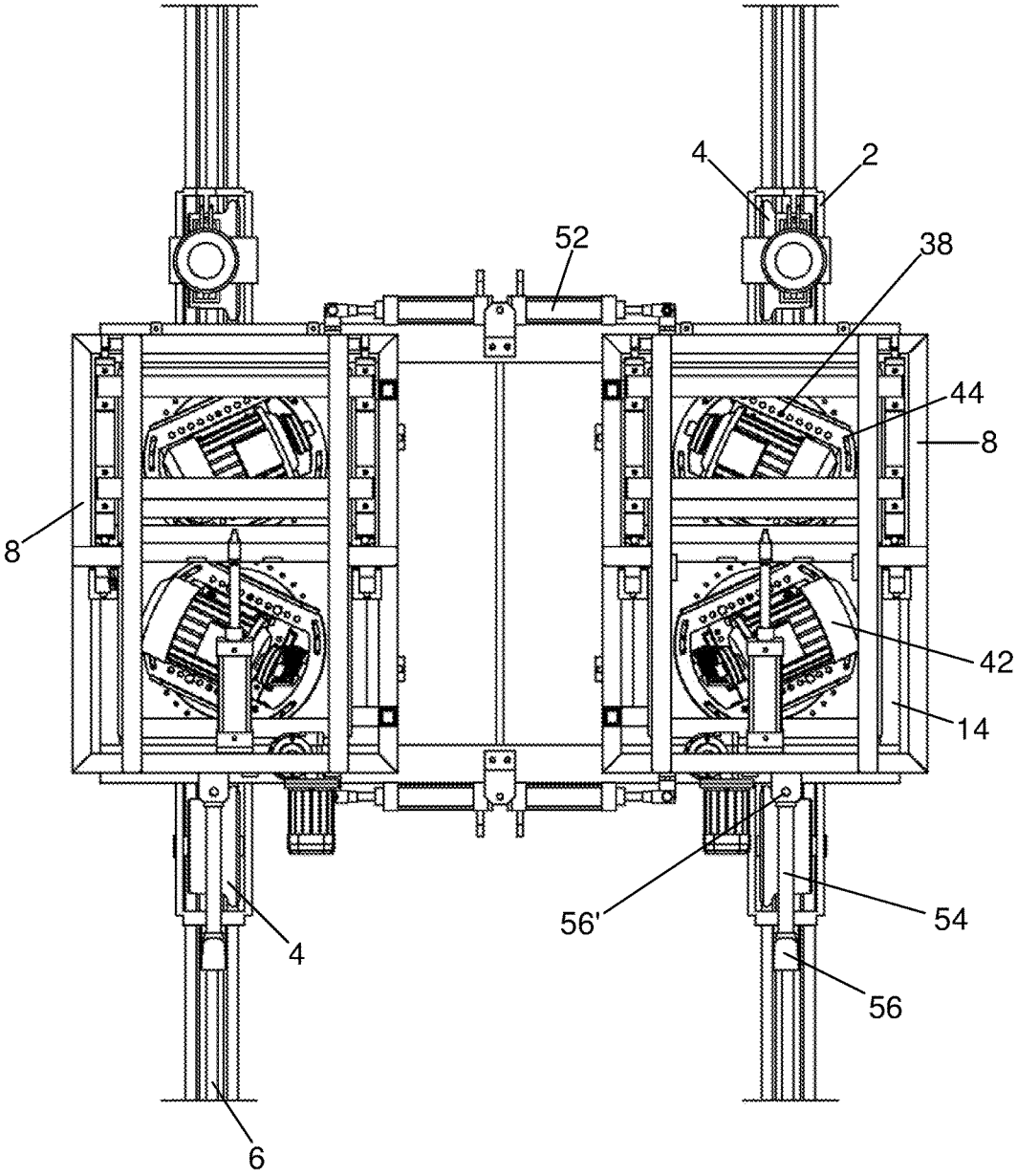
Figure 4:
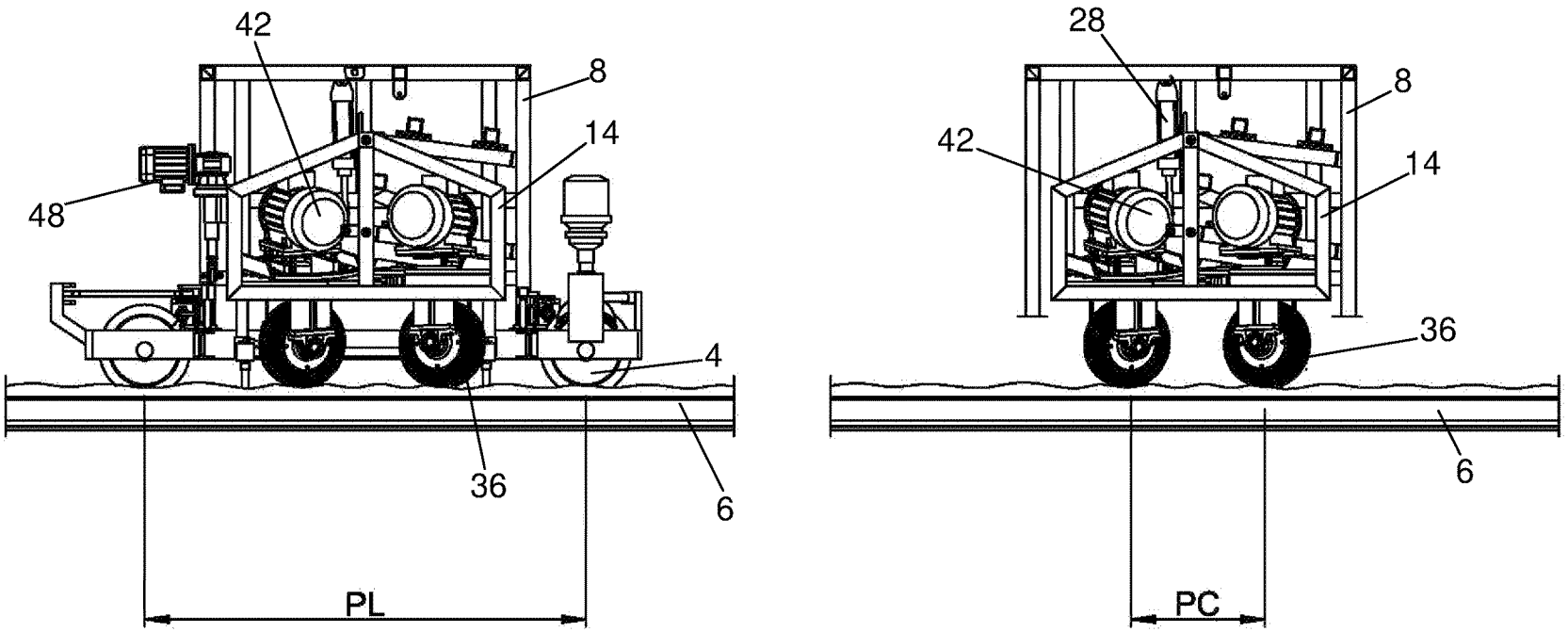
Figure 5:
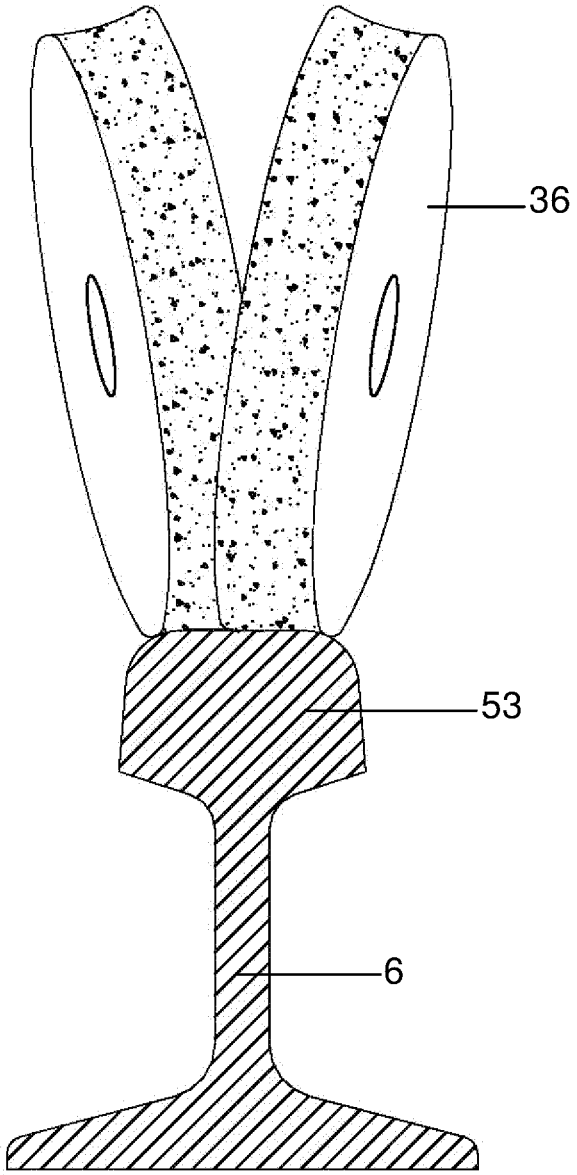

The present invention is further clarified hereinafter with reference to accompanying drawings, in which:

FIG. 1 is a perspective view of a grinding machine according to the invention, FIG. 2 shows it in lateral view, FIG. 3 shows it in plan view, FIG. 4 shows operation schemes for eliminating the long wave, and FIG. 5 is a partial view of the grinding frame with the grinding wheels worn.

As can be seen from the figures, the machine according to the invention comprises substantially a base structure 2 mounted on four wheels 4 slidable on the rails 6 to be ground. Two grinding units 8 are mounted on said base structure and are provided with cylindrical wheels 10 slidable along the cross-members 12 of the base structure 2. The grinding units 8 are movable transversely to the base structure 2 under the command of pneumatic systems 52.

Each grinding unit 8 comprises a frame 14 consisting of two parallel longitudinal members 16 joined together by cross-members 18, four frame stiffening uprights 20 being provided at the joint corners between the longitudinal members and cross-members.

The upper ends of the uprights are connected together by beams 22.

The uprights are provided with a pair of parallel oscillating guide arms 24 and 24' for the rigid vertical translation of the frame 14 relative to the grinding unit 8, and which engage in the uprights 26 of the frame 8 and in the uprights 29 of the frame 14 at pins 27.

Said vertical translation is achieved by a plurality of pneumatic systems 28 connected to the grinding unit 8, with their piston rods being rigid with the frame 14. The force required for the various operations can be adjusted as required, by a pressure regulation (not shown in the drawings).

Plates 30, hinged to the frame 14, are each connected to a corresponding flange 32 provided with brackets 34 for connecting an abrasive wheel 36. Each flange 32 is adjustable relative to the overlying plate 30 by axial rotation, and can be locked thereto by bolts which engage in pairs of slotted holes 44. Each grinding wheel 36 can be rotated by a pulley 40 rigid with the shaft of a corresponding electric motor 42 mounted on the flange 32.

In addition, each flange 32 is provided with a plurality of corresponding holes 38 to enable the brackets 34 supporting the grinding wheels 36 to translate outwards relative to the overlying plate 30, such that the two grinding wheels are not mutually aligned longitudinally, but lie on opposite sides of the centre line through the rail 6 to be ground.

By virtue of the facility for inclining the plates 30 relative to the frame 14, each grinding wheel 36 presents its rotational axis non-parallel to the rail rolling surface, and because of the facility for the flange 32 to be rotated axially about the plate 30 the two grinding wheels 36 can be disposed inclined inwards or outwards with reference to the direction of advancement along the rails.

In particular, as the inclination of the plate 30 to the frame 14 varies, the angle which the grinding wheel axis forms with the rail horizontal plane (inclination) varies, while the variation of the position of the flange 32 relative to the plate 30 causes the angle which the grinding wheel axis forms with the rail axis to vary (convergence).

To an upright 20, a gearmotor 48 is connected having its shaft rigid with a worm 50 of vertical axis, having its free end resting on the grinding unit 8. A control unit is associated with said gearmotor 48 to control its operation such that the frame 14 descends gradually as the grinding wheel is consumed.

A bar 54 is hinged, at hinges 56, 56', to the base structure 2 and to the frame 8 respectively.

The machine according to the invention also uses a plurality of rail position reference sensors which activate the various commands in implementing the grinding cycle.

To operate the machine, it first has to be transferred to the site on which the rail to be ground is located. This transfer is preferably implemented by a tractor which can also be provided with an electricity generating unit to remotely power the grinding machine, especially if electrification of the railway track to be ground is missing, or electrical feed has been temporarily suspended for maintenance work.

The horizontal pneumatic cylinder-piston units 52 are then operated to cause the units 8 to move transversely until the measurement sensors sense the position of the rail 6 and halt the travel to the frame 14.

As a result of this operation the bar 54 enables the frame 8 to be always in contact with the gauge side at two guides 58, such that the grinding wheel and rail profile intersect perfectly.

In the first stage, only the pneumatic cylinders 28 are used, such that the abrasive grinding wheels, rigid and mutually aligned, do not follow the undulation defects of the rail longitudinal plane, as one grinding wheel supports the other. The final grinding is implemented with a short pass pitch, SP, of length equal to the two grinding wheel-rail contact points, known as short wave grinding. In the second stage, to achieve fast lowering and possibly emergence of the frame 14, the pneumatic cylinders 28 are again used such that the free end of the worm 50 of the gearmotor 48 comes into contact with the frame 8.

To implement rail grinding and abrasion, the frame 14 is lowered by the gearmotor 48 with micrometric movements of the worm such that the grinding wheels 36 come into contact with the rail head 52 to create a movable longitudinal working plane of length equal to the long pass pitch, LP, determined by the two grinding wheel-rail contact points, known as long wave grinding.

To more clearly explain the aforegoing, the system of the invention can be likened to a planer, where the working surface is its length equivalent to the short pass pitch, SP, and LP pitch, which in the presence of an undulation cusp removes the excess material, by successive passes, by virtue of the force exerted by the operator who in the case of the invention is replaced by the pressure of the pneumatic cylinders 28. When instead the planer reaches the next valley, which must be smaller than its length, it causes no removal until all the existing cusps have been levelled, to finally achieve a linear working surface.

All the upward and downward movements both of the pneumatic cylinders 28 and of the gearmotor are controlled by a computerized system.

During these stages the frame 14 is lowered substantially rigidly by virtue of the guiding of the arms 24, 24' within the uprights 26.

The motors 42 are then operated to rotate the grinding wheels 36, which consequently carry out their abrasive effect in the case of short wave grinding (SP) with a working pressure suitably regulated by the aforesaid pressure regulators, and in the case of long wave grinding (LP) controlled by the gearmotors 48.

It should be noted that the particular arrangement of the grinding wheels (inclination, convergence and translation relative to the rail) means that the grinding wheels wear in accordance with a certain profile (shown in FIG. 5) independently of the worn and deformed shape of the rail. The combination of several grinding wheel profiles consequently enables the rail to be restored to its original profile (radii).

This means that having identified the correct grinding wheel profile for restoring the rail, grinding wheels can be used in which the profile is already derived during grinding wheel preparation in terms of its particular inclination, convergence and translation relative to the rail.

The brackets 34 can also be shifted relative to the plate 32 to vary the position of the grinding wheel centre line relative to the rail.

Two pneumatic units have been illustrated in the example, but these can be replaced by hydraulic cylinder-piston units, springs or other support means.

From the aforegoing it is clear that the tangential grinding machine according to the invention presents numerous advantages, and in particular:

- it enables total and perfect grinding of railway, tramway and/or subway rails, of whatever deformation,
- it adds the merits of tangential grinding wheels to those of traditional cup grinding wheels, while eliminating the drawbacks of these latter, which consist of the large number of tools and the faceting of the ground rail,
- it eliminates irregularity problems in the longitudinal plane in long wave and short wave grinding by virtue of the presence of the regulated frame 14, or of the cylinders 28 alone (SP) or by the cylinders 28 and by the gearmotor 48 (LP),
- by virtue of the control system achievable by lowering the gearmotor 48, it also enables effective grinding of the core of rail switches, crossovers, etc.

The invention claimed is:

1. A tangential grinding machine slidable on rails to be ground, comprising:

- a base structure (2) mounted on wheels (4) slidable on a rail to be ground;
- at least one grinding unit (8) freely slidable along cross-members of the base structure (2), said grinding unit (8) comprising a frame (14) rigidly movable vertically relative to said base structure (2) towards and away from the rail, said frame (14) rigidly supporting at least two longitudinally aligned plates (30) supporting a grinding wheel (36) with a rotatable axis transverse to a rail longitudinal axis and
- a bar (54) hinged having ends hinged to the base structure (2) and to the grinding unit (8) respectively,
- wherein a gear motor (48) is connected to the frame (14) supporting the plates (30) and is provided with a vertical axis worm gear (50), an end of the worm gear resting on the grinding unit (8), and
- wherein a control unit is associated with said gear motor to control frame descent following wear of the grinding wheel (36).

2. The tangential grinding machine as claimed in claim 1, wherein the frame of the grinding unit (8) is moved transversely by horizontal pneumatic cylinder-piston units (52) until measuring sensors sense a position of the rail (6).

3. The tangential grinding machine as claimed in claim 1, wherein each plate (30) has a surface with a flange (32) thereon, the flange supporting brackets (34) supporting the grinding wheel (36).

4. The tangential grinding machine as claimed in claim 3, wherein a connection between one of the plates (30) and the corresponding flange (32) is made by inserting bolts through pairs of slotted holes.

5. The tangential grinding machine as claimed in claim 3, wherein each grinding wheel is rotated by a corresponding motor (42) mounted on the corresponding flange (32).

6. The tangential grinding machine as claimed in claim 1, wherein the frame (14) is provided with guide arms (24, 24') engaged in uprights of the tangential grinding machine.

7. The tangential grinding machine as claimed in claim 3, wherein said flange (32) is axially rotatable relative to the plate (30).

8. The tangential grinding machine as claimed in claim 3, wherein the brackets (34) which support the grinding wheel are laterally movable relative to the flange (32) due to a plurality of holes (38).

9. The tangential grinding machine as claimed in claim 1, wherein each plate (30) has an inclination that is variable relative to the frame (14).

* * * * *